US007785121B2

(12) United States Patent
Ito et al.

(10) Patent No.: US 7,785,121 B2
(45) Date of Patent: Aug. 31, 2010

(54) FLAT CIRCUIT CONNECTOR WITH DUST COVER

(75) Inventors: Naotoshi Ito, Tokyo (JP); Kazushige Asakawa, Yokohama (JP)

(73) Assignee: Molex Incorporated, Lisle, IL (US)

( * ) Notice: Subject to any disclaimer, the term of this patent is extended or adjusted under 35 U.S.C. 154(b) by 124 days.

(21) Appl. No.: 11/658,960

(22) PCT Filed: Jul. 29, 2005

(86) PCT No.: PCT/US2005/026799

§ 371 (c)(1),
(2), (4) Date: Dec. 18, 2008

(87) PCT Pub. No.: WO2006/015126

PCT Pub. Date: Feb. 9, 2006

(65) Prior Publication Data

US 2009/0124106 A1 May 14, 2009

(30) Foreign Application Priority Data

Jul. 30, 2004 (JP) ..... 2004-224852

(51) Int. Cl.
*H01R 13/15* (2006.01)
*H01R 13/62* (2006.01)

(52) U.S. Cl. ..... 439/260; 439/495

(58) Field of Classification Search ..... 439/260, 439/261, 495, 41, 940
See application file for complete search history.

(56) References Cited

U.S. PATENT DOCUMENTS 4,634,195 A 1/1987 Shoemaker
7,063,559 B2 * 6/2006 Wang et al. ..... 439/495
7,077,691 B2 * 7/2006 Yokoo et al. ..... 439/495
7,291,040 B2 * 11/2007 Kato ..... 439/495
7,314,385 B2 * 1/2008 Tsukumo ..... 439/495
7,341,477 B2 * 3/2008 Kato ..... 439/495
2001/0046804 A1 11/2001 Fuchs et al.

FOREIGN PATENT DOCUMENTS

EP 0 878 873 A1 11/1998
JP 04-199166 1/1994
JP 10-208822 8/1998
JP 10-214661 8/1998

OTHER PUBLICATIONS

International Search Report and Written Opinion fro PCT Patent Application No. PCT/US2005/0026799. Jan. 12, 2005.

* cited by examiner

*Primary Examiner*—Hae Moon Hyeon
(74) *Attorney, Agent, or Firm*—Timothy M. Morella

(57) ABSTRACT

An electrical connector is provided for terminating a flat electrical circuit. The connector includes a dielectric housing having an opening at a front portion thereof for receiving an end of the flat circuit, along with a rear terminating portion. A plurality of terminals are mounted on the housing in a side-by-side array spaced along the opening. An actuator is movably mounted relative to the housing for movement between an open position allowing the end of the flat circuit to be inserted into the opening and a closed position to relatively bias the flat circuit against the terminals. The actuator has a dust cover portion for covering the rear terminating portion of the housing when the actuator is in its closed position.

17 Claims, 8 Drawing Sheets

FLAT CIRCUIT CONNECTOR WITH DUST COVER

CROSS REFERENCE TO RELATED APPLICATIONS

The Present Application is a U.S. National Phase entry from, and claims priority to, PCT Patent Application No. PCT/US2005/0026799, which was filed with the United States Receiving Office of the Patent Cooperation Treaty on 29 Jul. 2005. Further, the Present Application, through the PCT Patent Application referenced above, claims priority to Japanese Patent No. 4031471, granted on 26 Oct. 2007 and which was filed with the Japanese Patent Office on 30 Jul. 2004 as Japanese Patent Application No. 2004-224852.

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals. An example of these types of connectors is shown in Japanese Utility Model Application Laid-Open No. H6-17165.

In a widely used type of flat circuit connector, the flat circuit is insertable into a slot at the front of the connector housing, and the actuator is pivotally mounted on the housing generally at the top, front thereof overlying the slot in a closed position of the actuator. However, conventional flat circuit connectors have problems in that, when the connector is mounted on a printed circuit board and so used, debris, dust or other foreign objects may enter the electrical connection area between the contact portions of the terminals and the conductors on the flat circuit, possibly leading to short circuits between adjacent terminals and/or between adjacent conductors.

For example, when a printed circuit board is used with a thin display apparatus, such as a plasma display television which is to be fixed to a main body of the thin display apparatus, the circuit board is held in a substantially vertical position or plane. The circuit board then is screwed to the main body by using self-tapping screws. During the course of assembly, debris is generated upon attachment of the circuit board by use of the self-tapping screws. In this particular application, a flat circuit connector already has been mounted on the circuit board, and a flat circuit already has been inserted into the connector. Therefore, the above-mentioned debris may fall onto the connector, particularly when the connector is located beneath the tapping screw locations. The debris often will enter the connection area between the terminals of the flat circuit connector and the conductive traces on the printed circuit board, or the debris may enter or fall into the connection area between the contact portions of the terminals and the conductors on the flat circuit. This can lead to short circuits between the terminals, between the conductors and/or between the circuit traces on the circuit board. The short circuits may electrically break a circuit in the thin display apparatus and result in a large loss. Of course, this example is but one example where debris often can enter flat circuit connectors creating the above problems. The present invention is directed to solving such problems.

SUMMARY OF THE INVENTION

An object, therefore, of the invention is to provide a new and improved connector for terminating a flat electrical circuit.

In the exemplary embodiment of the invention, a flat circuit connector includes a dielectric housing having an opening at a front portion thereof for receiving an end of the flat circuit, along with a rear terminating portion. A plurality of terminals are mounted on the housing in a side-by-side array spaced along the opening. An actuator is movably mounted relative to the housing for movement between an open position allowing the end of the flat circuit to be inserted into the opening and a closed position to relatively bias the flat circuit against the terminals. The actuator has a dust cover portion for covering the rear terminating portion of the housing when the actuator is in its closed position.

As disclosed herein, the actuator is generally L-shaped, as defined by a body portion and the dust cover portion. The body portion is generally parallel to the insertion direction of the flat circuit when the actuator is in its closed position. The dust cover portion is generally perpendicular to the insertion direction when the actuator is in its closed position. The actuator also includes a pressing portion for biasing the flat circuit against the terminals when the actuator is in its closed position.

According to some features of the invention, the dust cover portion of the actuator includes a recessed dust accumulation area to prevent the dust from falling off of the connector. The dust cover portion also includes a flat suction surface area for the application thereto of suction by a vacuum pick-up unit. The flat suction surface is generally parallel to the insertion direction of the flat circuit when the actuator is in its open position.

Other features of the invention include complementary interengaging surfaces between the actuator and the housing to maintain the actuator in its open position. Complementary interengaging surfaces also are provided between the actuator and the housing to maintain the actuator in its closed position.

Finally, in the exemplary embodiment, the connector is adapted for mounting on a printed circuit board, with the terminals soldered to appropriate circuit traces on the board. The actuator includes at least one through hole for the passage there through of cooling air during a soldering process. As disclosed herein, the through hole extends generally parallel to the printed circuit board when the actuator is in its open position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
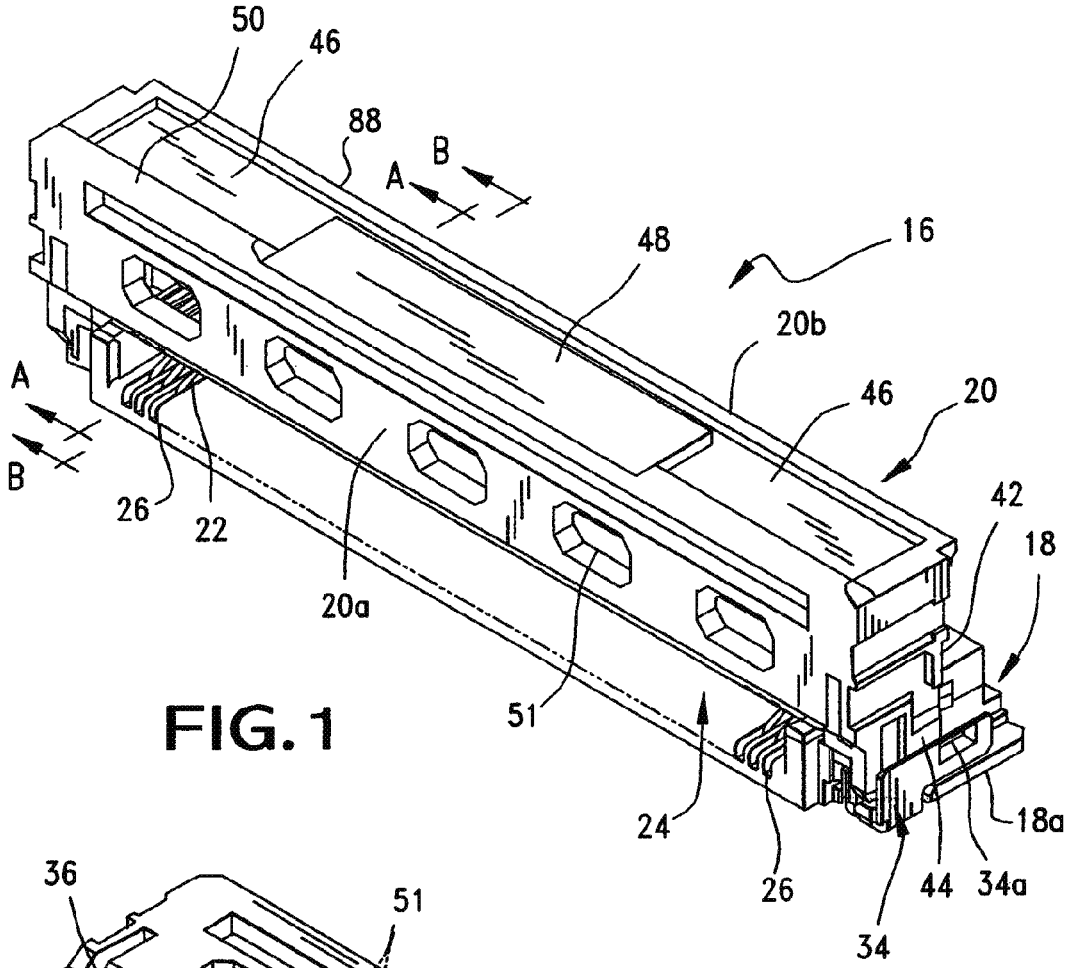
FIG. 1 is a top, front perspective view of a flat circuit connector according to the invention, with the actuator in its open position.
Figure 3:
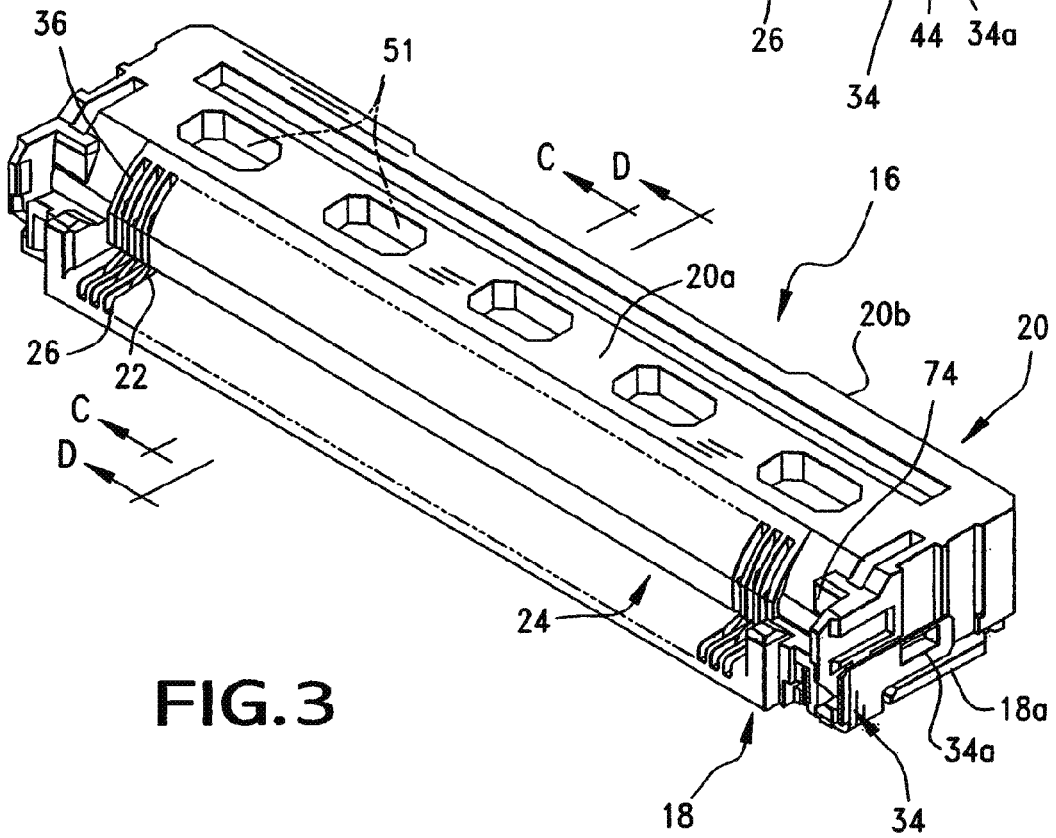
FIG. 3 is a view similar to that of FIG. 1, but with the actuator in its closed position.

Before proceeding with a detailed description of the preferred embodiment, it should be understood that such terms as "top", "bottom", "front", "rear", "up", "down" and the like herein and in the claims hereof are not meant in any way to be limiting in nature. Such terms are used solely to provide a clear and concise understanding of the invention, as depicted in the drawings. For instance, in the Background, above, it already has been pointed out that the connector may be mounted on a printed circuit board and installed in an apparatus with the board in a vertical orientation. Therefore, the "rear" of the connector as viewed in the drawings herein, would become the top of the connector when so installed in the apparatus. In addition, the term "flat circuit" herein and in the claims hereof is intended to refer to all kinds of flat electrical cables, including but not limited to flat flexible circuits, flexible printed circuit boards, flat rigid and flexible cables or the like.

With those understandings, FIGS. 1-4 show a flat circuit connector, generally designated 16, according to an exemplary embodiment of the invention. The connector is configured for mounting on a printed circuit board (not shown), and the connector is provided for terminating a flat electrical circuit (also not shown). Connector 16 includes two main components, namely a dielectric housing, generally designated 18, and an actuator, generally designated 20, movably mounted on the housing, along with a plurality of conductive terminals, generally designated 22, mounted on the housing in a side-by-side array longitudinally thereof. Actuator 20 is pivotally mounted relative to housing 18 for pivotal movement between an open position (FIGS. 1 and 2) allowing an end of the flat circuit to be inserted into the connector and a closed position (FIGS. 3 and 4) to bias the flat circuit against the terminals. The housing and/or actuator define an insertion opening, generally designated 24, at a front portion of the housing for receiving the end of the flat circuit for termination to terminals 22 of the connector. Each of the housing 18 and the actuator 20 may be a one-piece structure unitarily molded of dielectric material such as plastic or the like. The terminals typically are stamped from conductive sheet metal material. The flat circuit has spaced conductors laterally thereof.

Figure 2:
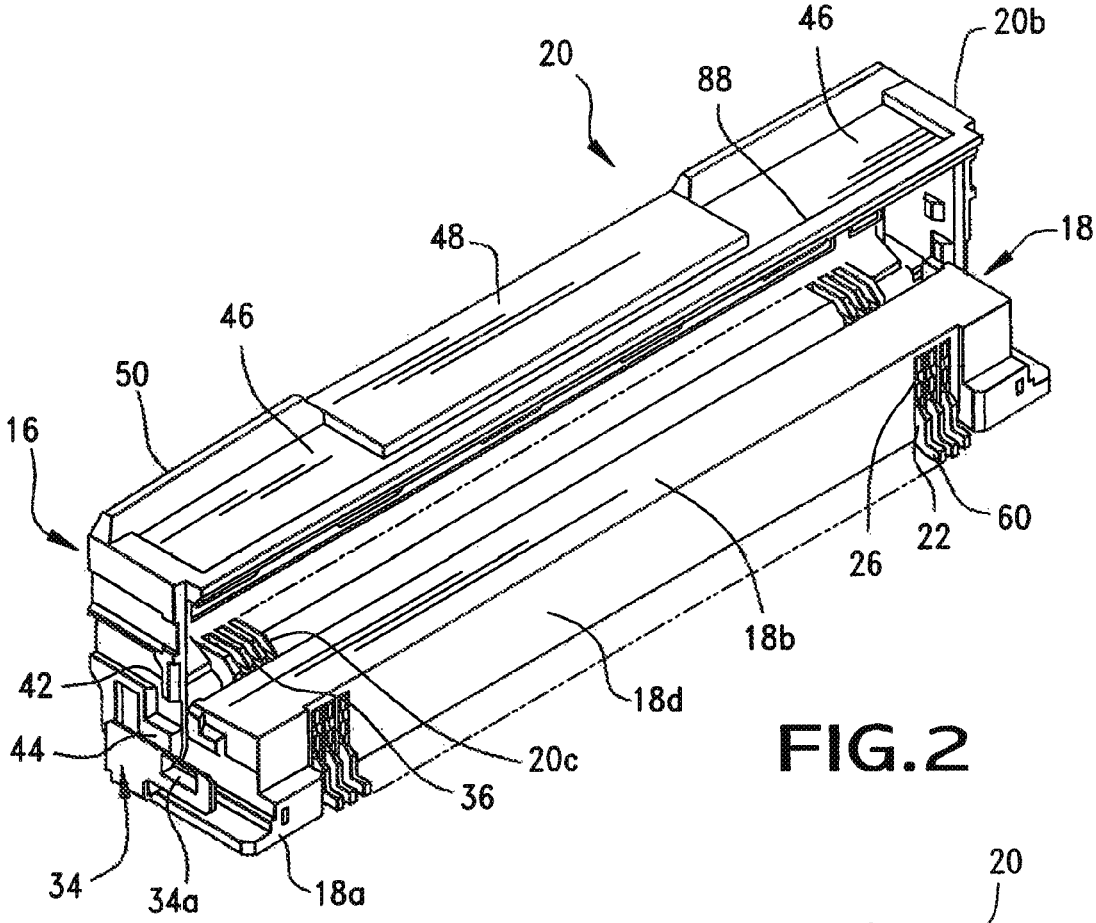
FIG. 2 is a top, rear perspective view of the connector, with the actuator in its open position.
Figure 4:
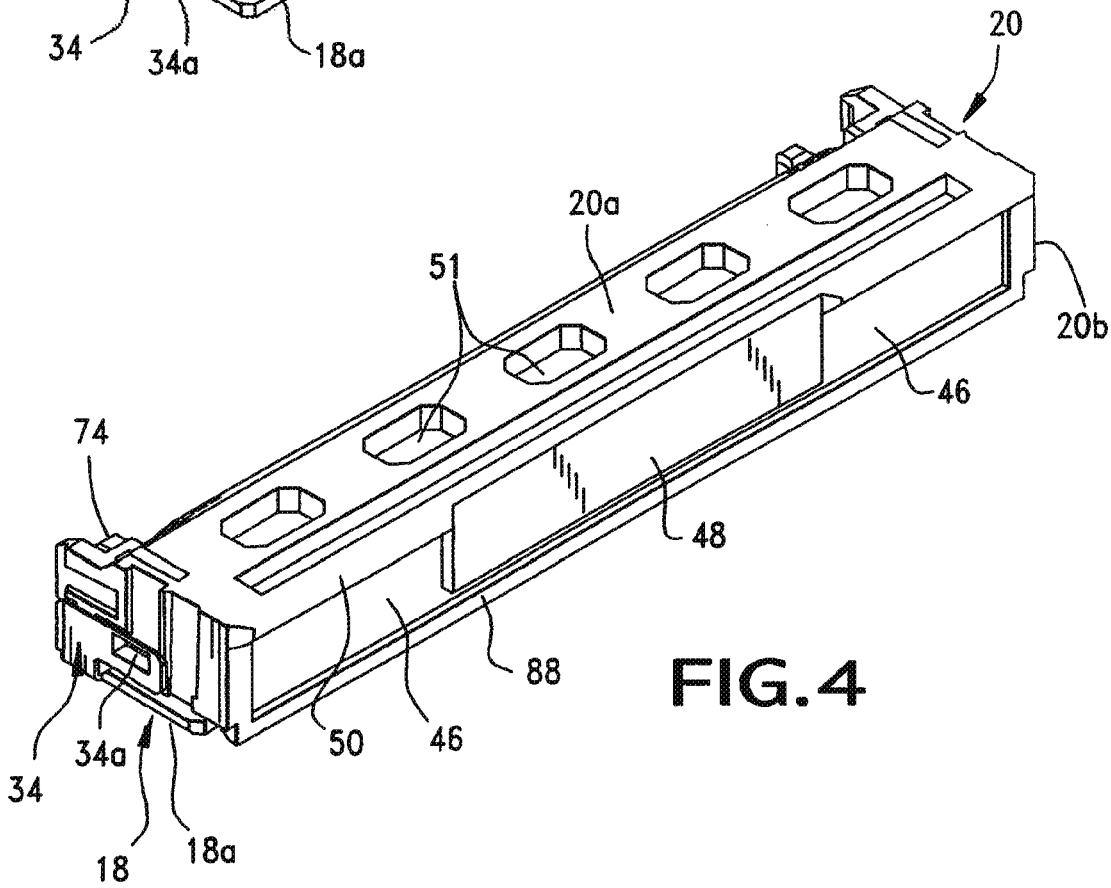
FIG. 4 is a view similar to that of FIG. 2, but with the actuator in its closed position.
Figure 6:
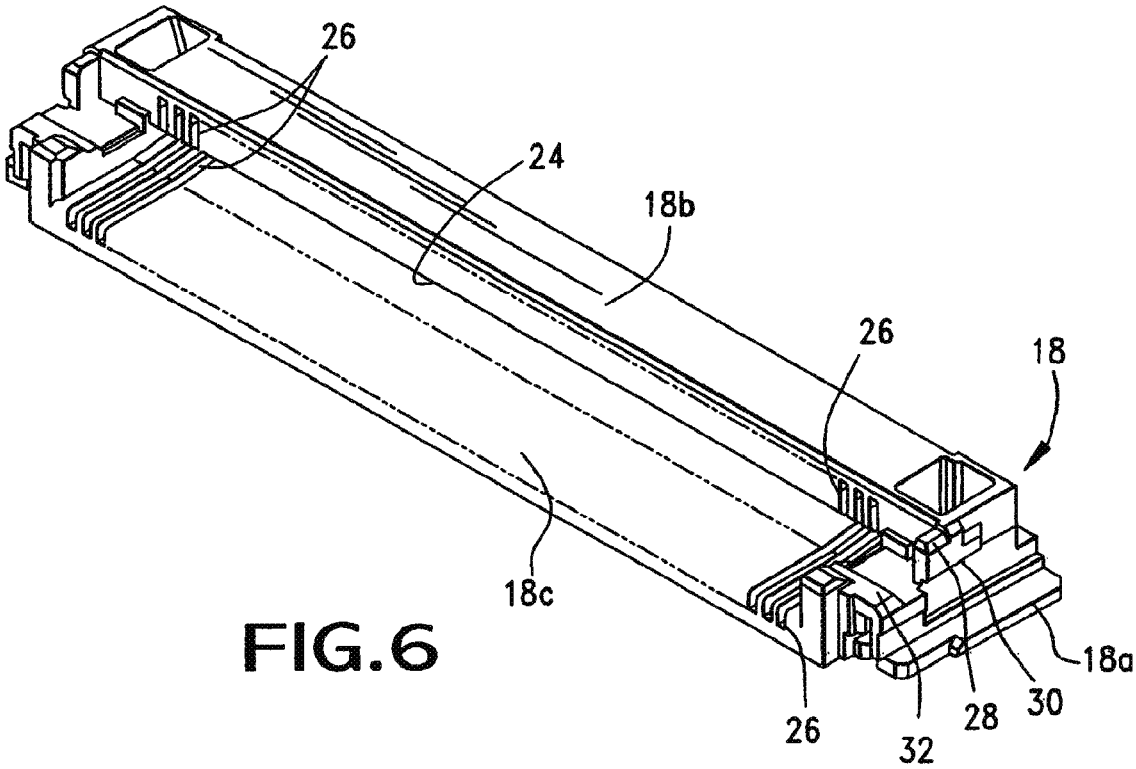
FIG. 6 is a top, front perspective view of the connector housing.

Referring to FIG. 6 in conjunction with FIGS. 1-4, dielectric housing 18 includes a lower portion 18*a*, an upper portion 18*b*, a front portion 18*c* and a rear terminating portion 18*d* (FIG. 2). Insertion opening 24 extends from above front portion 18*c* to an open area between lower portion 18*a* and upper portion 18*b*. A plurality of terminal receiving passages 26 are formed in the housing for mounting terminals 22 in a side-by-side array spaced along insertion opening 24. For instance, there may be as many as seventy terminal-receiving passages 26 formed at a pitch or spacing of approximately 0.5 mm, with a single terminal mounted in each passage. On the other hand, some passages may be void of terminals depending upon the arrangement of the conductors on the flat circuit and/or the circuit traces on the printed circuit board.

As best seen in FIG. 6 and for purposes described hereinafter, each end of housing 18 is provided with a first, angled engagement surface 28 and a second, angled engagement surface 30. It will be seen that these engagement surfaces facilitate maintaining actuator 20 in either its open or closed positions. In addition, an abutting engagement surface 32 is provided at each opposite end of the housing.

As seen in FIGS. 1-4, a fitting nail, generally designated 34, is mounted at each, opposite end of housing 18. The fitting nails are stamped and formed of metal material and are secured, as by soldering, to appropriate mounting pads on the printed circuit board to fix the housing and, thereby, the connector to the circuit board. Each fitting nail pas an engagement projection 34*a* which extends or projects inwardly toward the housing.

Figure 5:
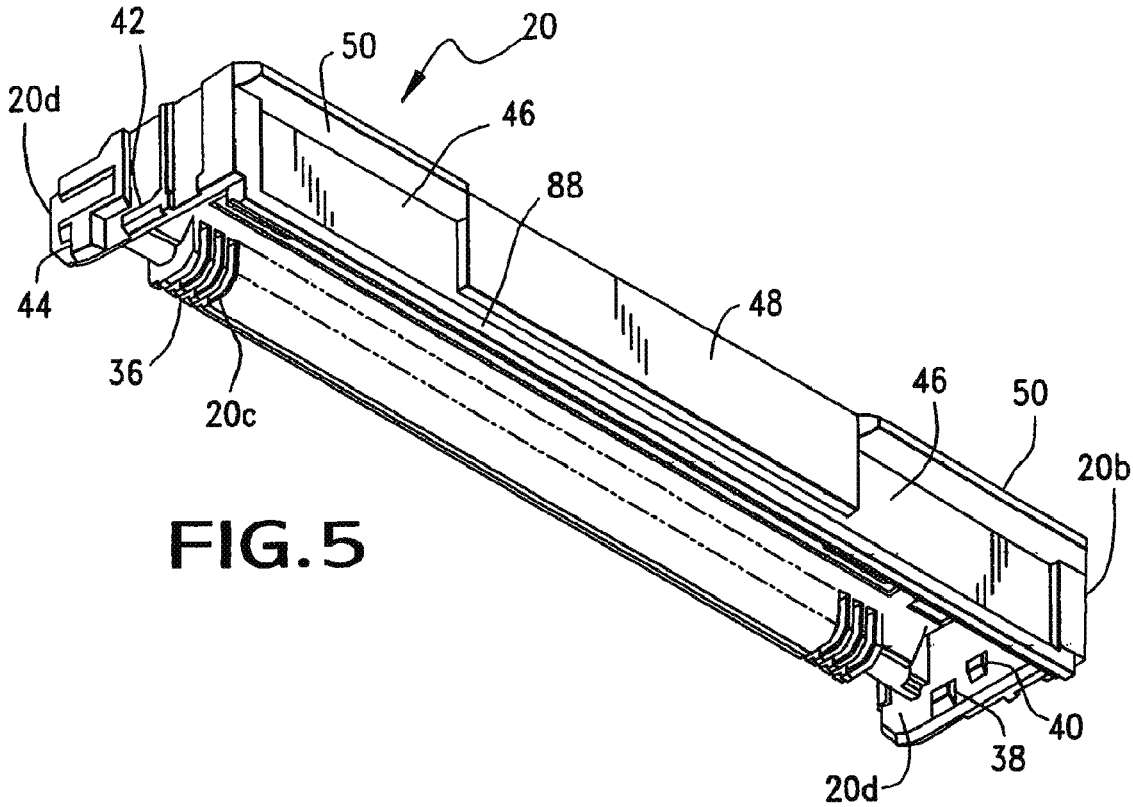
FIG. 5 is a bottom perspective view of the actuator, as if the actuator were in its closed position.

Referring to FIG. 5 in conjunction with FIGS. 1-4, actuator 20 is generally L-shaped in front-to-rear cross-section, as defined by a main body portion 20 (FIGS. 1 and 3) and a dust cover portion 20*b*, along with a pressing portion 20*c* for biasing the flat circuit into engagement with the terminals. Actually, pressing portion 20*c* is formed by a plurality of pressing ribs which separate or form partitions between a plurality of terminal accommodating grooves 36. The ribs combine to form a composite pressing portion of the actuator. The actuator also includes a pair of end walls 20*d* which have first and second, angled engagement surfaces 38 and 40, respectively, on the inside of each end wall thereof as best seen in FIG. 5. These angled engagement surfaces cooperate with the angled engagement surfaces 28 and 30 (FIG. 6) of the housing to maintain the actuator in either its open or closed position. Also, as best seen in FIG. 5, the outside of each end wall 20*d* is provided with a pair of engagement projections 42 and 44 which engage one of the fitting nails 34, particularly, the engagement projection 34*a* thereof.

Actuator 20 further includes a number of other unique features. First, recessed dust accumulation areas 46 are formed in the outside surface of dust cover portion 20*b* of the actuator. These recessed dust accumulation areas will face upwardly when the actuator is in its closed position, and with the connector mounted on a vertically oriented printed circuit board as described in detail in the Background, above. Dust or debris will accumulate in these recessed areas and not fall downwardly onto or around the connector or into the termination area of the connector. Dust cover portion 20*b* of the actuator also is provided with a flat suction surface 48 for the application thereto of suction by a vacuum pick-up unit for manipulating and moving the entire connector during fabrication of various electrical apparatus. A pair of grasping flanges 50 are disposed at opposite ends of flat suction surface 48 and project outwardly from a corner between body portion 20*a* and, dust cover portion 20*b* of the actuator. The grasping flanges can be grasped by an operator's fingers for pivotally moving the actuator relative to the housing. Finally, a plurality of through holes 51 extend through body portion 20*a* of actuator 20 for the passage of cooling air there through during a terminal soldering process. The through holes extend generally parallel to the printed circuit board when the actuator is in its open position as shown in FIG. 1.

Figure 7:
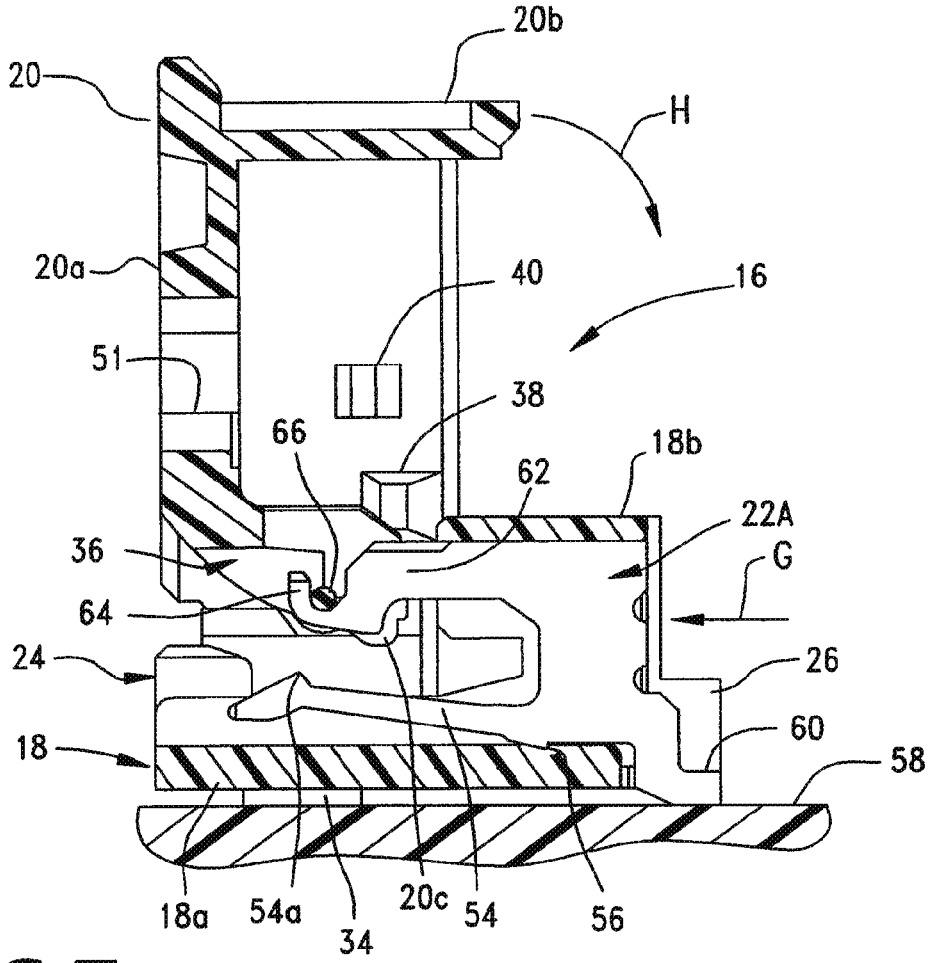
FIG. 7 is an enlarged vertical section taken generally along line A-A in FIG. 1.
Figure 8:
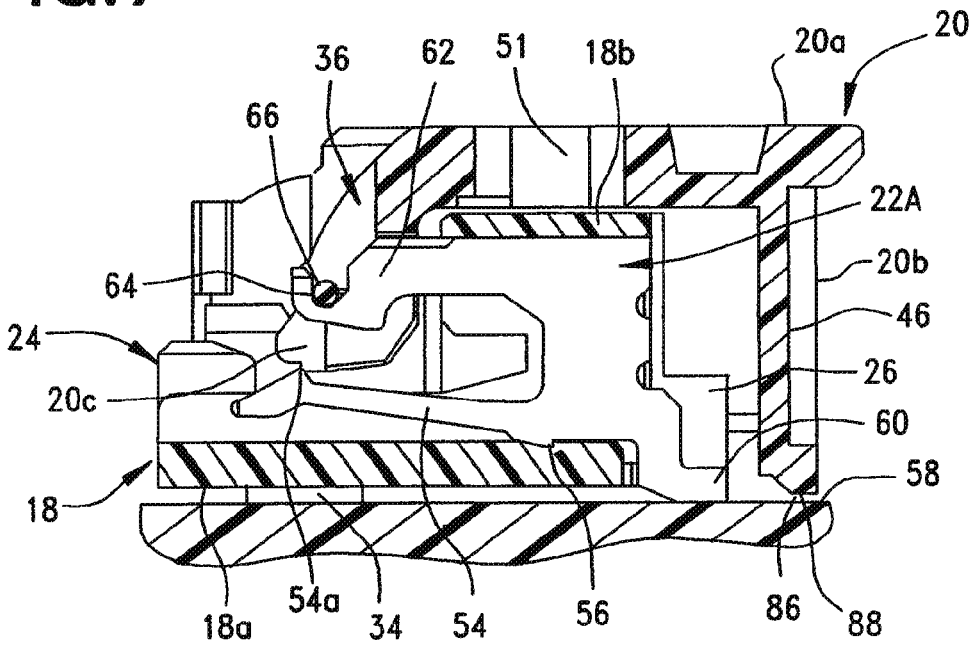
FIG. 8 is an enlarged vertical section taken generally along line C-C in FIG. 3.
Figure 9:
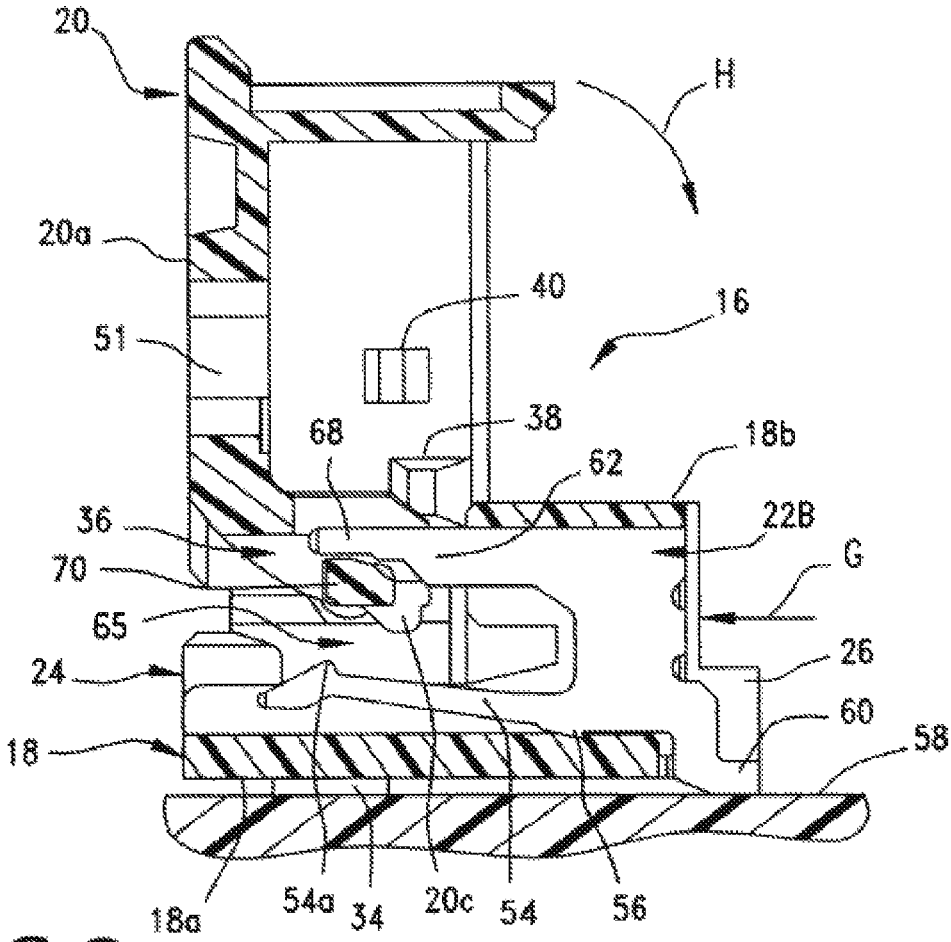
FIG. 9 is an enlarged vertical section taken generally along line B-B in FIG. 1.
Figure 10:
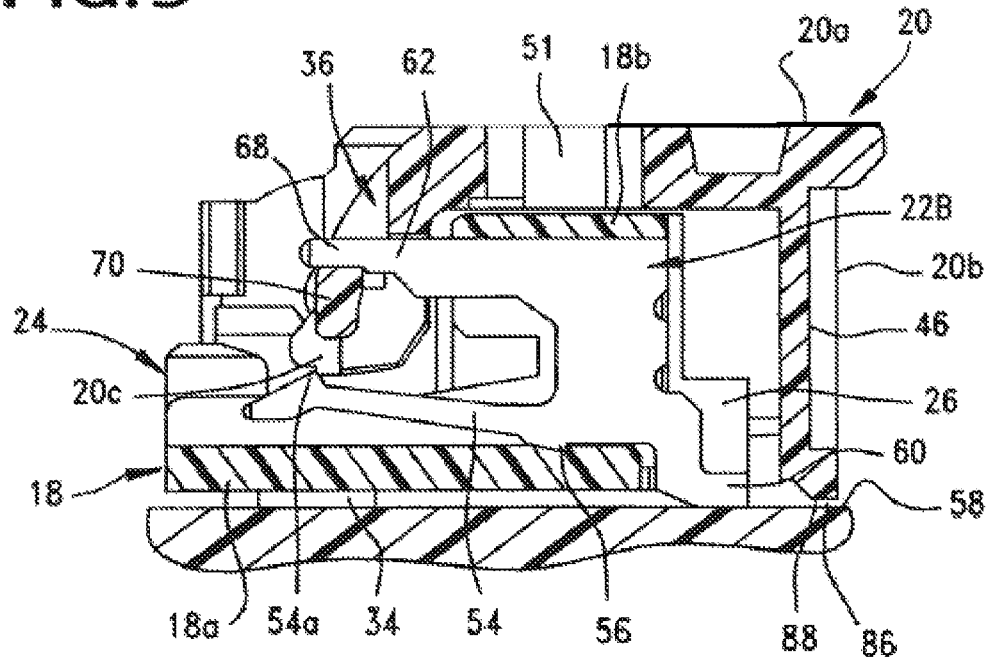
FIG. 10 is an enlarged vertical section taken generally along line D-D in FIG. 3.

FIGS. 7-10 show details of terminals 22 of the connector. There are two different types of terminals, generally designated 22A and 22B, which alternate in a side-by-side array longitudinally along insertion opening 24. FIGS. 7 and 8 are sectional views through the connector showing the first type of terminal 22A, and FIGS. 9 and 10 are sectional views showing the second type of terminal 22B. Both types of terminals are generally V-shaped and include a contact spring arm 54 at the bottom of insertion opening 24. Each contact spring arm has an upwardly directed contact portion 54*a* at the distal end of the arm. The terminals are inserted into the rear of housing 18 in the direction of arrows "G" (FIGS. 7 and 9) into respective ones of the terminal-receiving passages 26. The terminals are fixed within the passages and include teeth portions 56 for biting into the plastic material of the housing within the passages and prevent the terminals from backing out of the passages. FIGS. 7-10 show connector 16 mounted on a printed circuit board 58, and the terminals include tail portions 60 for surface connection, as by soldering, to appropriate circuit traces on the printed circuit board. Finally, all of the terminals 22A and 22B have upper rigid arms 62 which project forwardly into terminal-receiving passages 26 at the tops of the passages and spaced above contact spring arms 54. Therefore, rigid arms 62 and contact spring arms 54 combine to form a mouth, generally designated 65, therebetween for receiving a leading end of the flat circuit which is inserted into insertion opening 24.

Each first terminal 22A differs from each, alternating second terminal 22B in that the distal end of the rigid arm 62 of the first terminal is provided with an upwardly facing pivot socket 64 as seen in FIGS. 7 and 8. The pivot socket end of the rigid arms of the first terminals extend into alternating ones of the terminal accommodating grooves 36 of actuator 20. As stated above, the pressing portion of the actuator is formed by a plurality of pressing ribs 20*c* which separate grooves 36. As seen in FIGS. 7 and 8, integral pivot pin portions 66 of the actuator span grooves 36 between ribs 20*c*, and the pivot pin portions seat within pivot sockets 64 of first terminals 22A.

Referring to FIGS. 9 and 10, second terminals 22B differ from the first terminals in that the distal end of the rigid arm 62 of each second terminal is provided with a rigid cam tip 68. This rigid cam tip is engageable by a cam portion 70 on actuator 20. Cam portions 70 span alternating terminal accommodating grooves 36 between pressing ribs 20*c*, similar to pivot pin portions 66 described above in relation to FIGS. 7 and 8. In other words, alternating grooves 36 are provided with pivot pin portions 66 while the remaining grooves are provided with cam portions 70. The cooperative relationship of actuator 20 and the first and second terminals 22A and 22B, respectively, will now be described. It can be understood from the above descriptions that the actuator is pivotally mounted on housing 18 by means of terminals 22A and 22B, namely the distal ends of rigid arms 62 of the terminals. FIGS. 7 and 8 show pivot pin portions 66 seated within the tops of pivot sockets 64 of first terminals 22A. On the contrary, FIGS. 9 and 10 show that cam portions 70 of the actuator abut against the bottoms of cam tips 68 of second terminals 22B. Therefore, the actuator is captured by engaging the tops and bottoms of the alternating terminals, and pivot pin portions 66 cannot move out of pivot sockets 64 because cam portions 70 abut against the bottoms of cam tips 68. FIGS. 7 and 9 show actuator 20 in its open position which allows the leading end of the flat circuit to be inserted into insertion opening 24 and then into mouth 65 which is defined between the respective arms of all of the V-shaped terminals. The actuator then is pivoted downwardly in the direction of arrow "H" (FIGS. 7 and 9) to its closed position shown in FIGS. 8 and 10. As the actuator pivots to its closed position, pressing ribs 20*c* press downwardly on the flat circuit and bias the conductors at the bottom of the flat circuit into engagement with contact portions 54*a* of all of the terminals.

Figure 11:
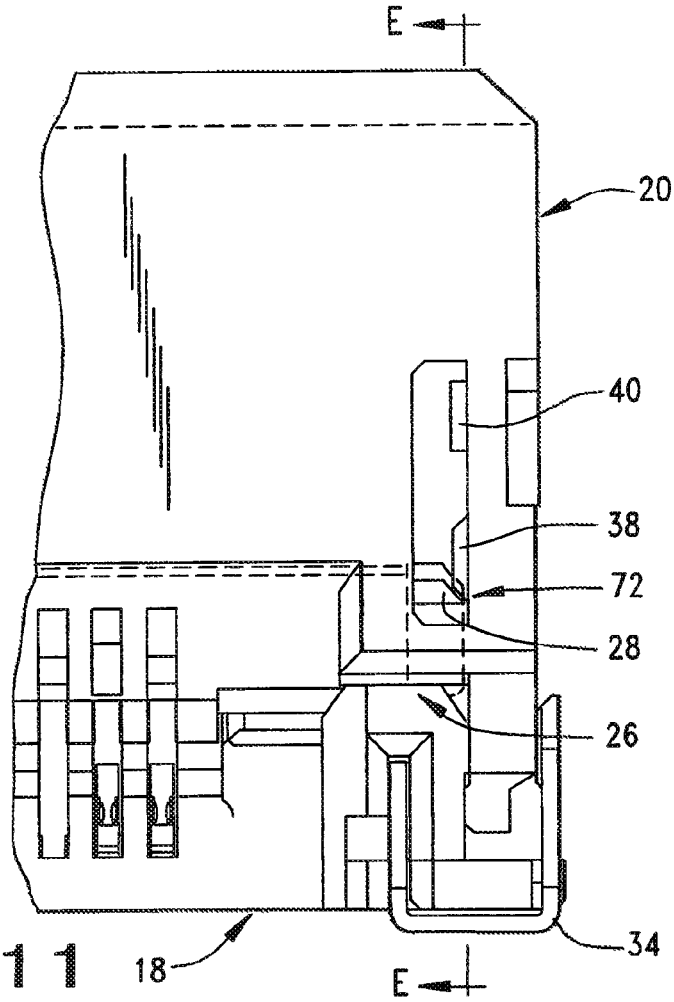
FIG. 11 is a fragmented, enlarged front elevational view looking at one end of the connector, with the actuator in its open position.
Figure 12:
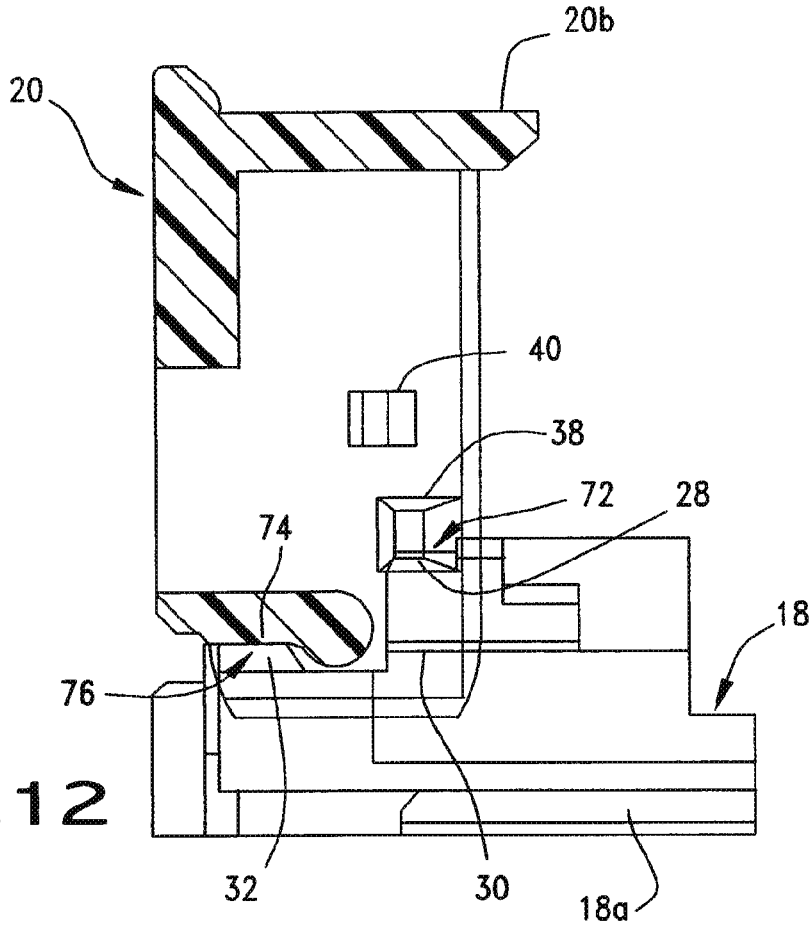
FIG. 12 is a vertical section taken generally along line E-E in FIG. 11.

FIGS. 11 and 12 show engagement areas, generally designated 72, at opposite ends of the connector for maintaining actuator 20 in its open position, as shown. Specifically, the first, angled engagement surface 28 on the housing is shown in engagement with the first, angled engagement surface 38 on the actuator. It can be seen that the abutting engagement surface 32 described above in relation to FIG. 6 is flat and faces upwardly against an abutting engagement surface 74 to define a second engagement area, generally designated 76 for maintaining the actuator in its open position. Still further, the interengagement of engagement projections 42 and 44 (FIG. 5) with engagement projections 34*a* (FIG. 1) of fitting nails 34 also help maintain the actuator in its open position. All of these interengaging surfaces prevent the actuator from moving toward its closed position when exposed to unexpected external forces stemming from vibration or the like exerted on the actuator. However, since the sides of engagement projections 28 and 38 on the housing and the actuator, respectively, are angled, an operator can intentionally move the actuator from its open position to its closed position by overcoming the engagement forces between the angled engagement surfaces.

Figure 13:
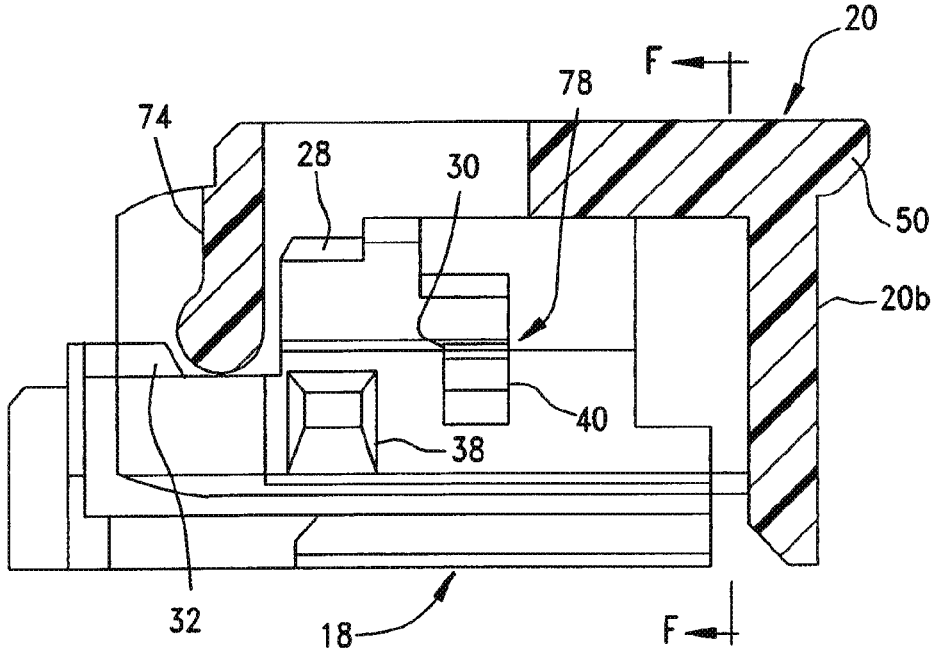
FIG. 13 is a vertical, front-to-rear section taken through one end of the connector, with the actuator in its closed position.
Figure 14:
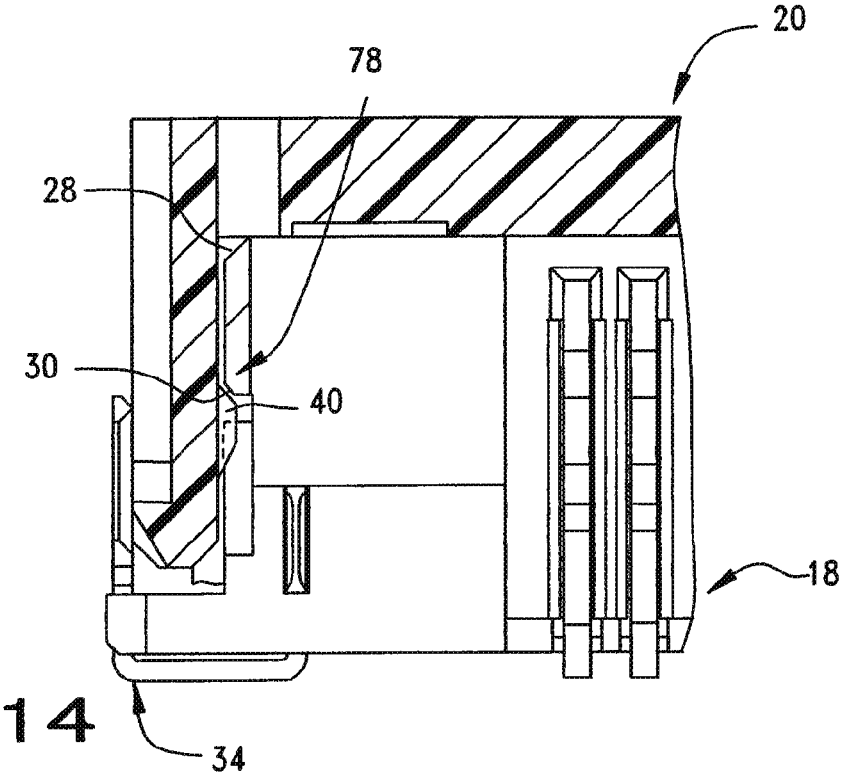
FIG. 14 is a vertical section taken generally along line F-F in FIG. 13.

FIGS. 13 and 14 show the means for maintaining actuator 20 in its closed position, as shown. Specifically, an engagement area, generally designated 78, is formed by the second, angled engagement surfaces 30 on housing 18 and the second, angled engagement surfaces 40 on actuator 20. The interengagement of these surfaces maintain the actuator in its closed position and prevents the actuator from moving out of the closed position when subject to unexpected external forces stemming from vibrations or the like. Like the first engagement surfaces, the second engagement surfaces 30 and 40 are angled so that an operator can engage grasping flanges 50 and pivot the actuator back to its open position.

Figure 15:
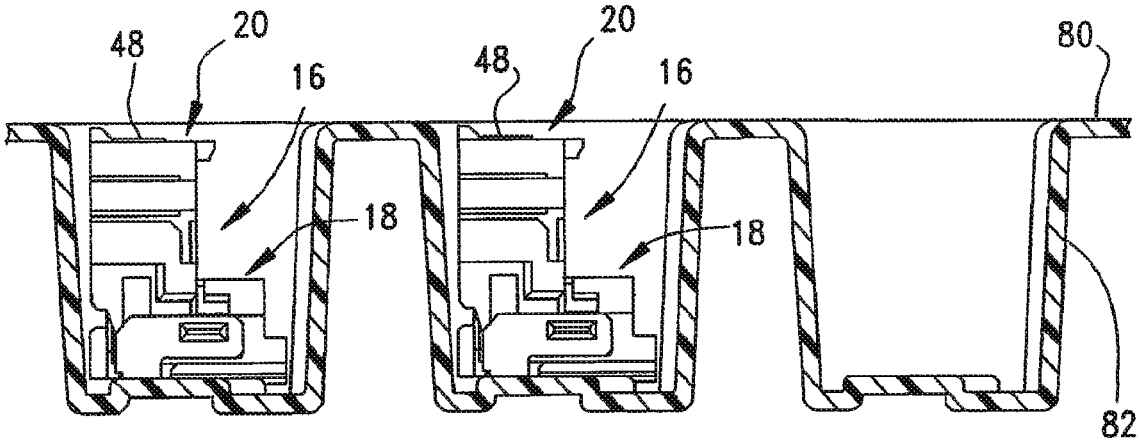
FIG. 15 is a section through a carrier strip which carries a plurality of flat circuit connectors according to the invention.

Finally, FIG. 15 shows a carrier strip 80 for transporting a plurality of connectors 16 during manufacture and/or assembly thereof and use in conjunction with a printed circuit board. Specifically, carrier strip 80 has a plurality of pockets 82 within which connectors 16 are positioned, with the housings 18 of the connectors resting on the bottom walls of the pockets. It can be seen that actuators 20 of the connectors are in their open positions, which means that the flat suction surfaces 48 of the actuators face upwardly for access by a vacuum pick-up unit which applies vacuum to the flat suction surfaces to move the connectors into and out of pockets 82, as well as moving the connectors to other stations for fabrication purposes.

For instance, fully assembled connectors 16 may be moved out of pockets 82 and positioned onto a printed circuit board for a wave soldering process. During the soldering operation, tail portions 60 of terminals 22 are soldered to appropriate circuit traces on printed circuit board 58, while fitting nails 34 are soldered to appropriate mounting tabs on the circuit board. With the actuator of a respective connector in its open position during this soldering process, through holes 51 in body portion 20*a* of the actuator are open in a direction generally parallel to the circuit board for the passage there through of cooling air during the soldering process.

After one of the connectors 16 is solder-connected to the printed circuit board, a flat circuit is inserted into insertion opening 24 of the connector. Actuator 20 then is pivoted from its open position to its closed position to bias the conductors of the flat circuit against contact portions 54*a* of terminals 22 to terminate the flat circuit within the connector.

As stated in the Background, above, a connector 16 mounted on a printed circuit board, with a flat circuit terminated in the connector, may be mounted in an electronic apparatus, such as a thin display apparatus in a plasma display television, with printed circuit board 58 in a vertical orientation, and with the outside face of dust cover portion 20*b* of actuator 20 facing upwardly. The dust cover portion prevents debris from falling into the connection area between tail portions 60 of terminals 22 and the circuit traces on printed circuit board 58. The dust cover portion also prevents debris from falling into the termination area between the conductors on the flat circuit and contact portions 54*a* of the terminals. Such debris might short the terminals and cause major damage. The recessed dust accumulation areas 46 allow the debris to accumulate therein and not fall further downwardly into the electronic apparatus.

It should be understood that the term "dust" herein is intended to encompass debris of a size which might create a shorting between adjacent terminals in the connector. For instance, as seen in FIGS. 8 and 10, with actuator 20 in its closed position, there may be a slight gap 86 between an edge 88 of dust cover 20*b* and the surface of printed circuit board 58. However, manufacturing tolerances are such that this gap will not be sufficiently large to allow debris of any size to fall there through which might short the terminals. Debris smaller than the pitch between the terminals most likely will not cause shorting, and gap 86 is much smaller than this pitch.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector for terminating a flat electrical circuit, comprising:

a dielectric housing, the dielectric housing having an opening, at a front portion thereof for receiving an end of the flat electrical circuit, and a rear terminating portion;

a plurality of terminals mounted on the dielectric housing in a side-by-side array spaced along the opening; and an actuator movably mounted relative to the dielectric housing for movement between an open position, allowing the end of the flat circuit to be inserted into the opening, and a closed position, to relatively bias the flat electrical circuit against the terminals, the actuator having a dust cover portion for covering the rear terminating portion of the dielectric housing when the actuator is in its closed position.

2. The electrical connector of claim 1, wherein the dust cover portion of the actuator includes a recessed dust accumulation area to prevent dust from falling off the dust cover portion.

3. The electrical connector of claim 1, wherein the dust cover portion of the actuator includes a flat suction surface area for the application thereto of suction by a vacuum pick-up unit.

4. The electrical connector of claim 3, wherein the flat suction surface area is generally parallel to the insertion direction of the flat electrical circuit when the actuator is in its open position.

5. The electrical connector of claim 1, wherein the electrical connector is adapted for mounting on a printed circuit board, wherein the terminals are soldered to appropriate circuit traces on the printed circuit board and the actuator includes at least one through-hole for the passage therethrough of cooling air during a soldering process.

6. The electrical connector of claim 5, wherein the through-hole extends generally parallel to the printed circuit board when the actuator is in its open position.

7. The electrical connector of claim 1, further comprising complementary interengaging surfaces between the actuator and the dielectric housing to maintain the actuator in its open position.

8. The electrical connector of claim 1, further comprising complementary interengaging surfaces between the actuator and the dielectric housing to maintain the actuator in its closed position.

9. The electrical connector of claim 1, wherein the actuator is generally L-shaped as defined by a body portion and the dust cover portion, the body portion being generally parallel to the insertion direction of the flat electrical circuit when the actuator is in its closed position, and the dust cover portion being generally perpendicular to the insertion direction when the actuator is in its closed position.

10. The electrical connector of claim 9, wherein the actuator further includes a pressing portion for biasing the flat electrical circuit against the terminals when the actuator is in its closed position.

11. An electrical connector for mounting on a printed circuit board and for terminating a flat electrical circuit, comprising:

a dielectric housing having a top portion, a bottom portion mounted to the printed circuit board, a front portion and a rear terminating portion, the front portion having an opening for receiving an end of the flat electrical circuit inserted into the opening in an insertion direction generally parallel to the printed circuit board;

a plurality of terminals, mounted on the dielectric housing in a side-by-side array spaced along the opening, and including contact portions exposed in the opening and tail portions connected to appropriate circuit traces on the printed circuit board; and an actuator pivotally movably mounted relative to the dielectric housing for movement between an open position, allowing the end of the flat electrical circuit to be inserted into said opening, and a closed position, wherein a pressing portion of the actuator biases the flat electrical circuit against the contact portions of the terminals, the actuator having a dust cover portion for covering the rear terminating portion of the dielectric housing when the actuator is in its closed position.

12. The electrical connector of claim 11, wherein the dust cover portion of the actuator includes a recessed dust accumulation area to prevent dust from falling off of the dust cover portion.

13. The electrical connector of claim 11, wherein the dust cover portion of the actuator includes a flat suction surface area for the application thereto of suction by a vacuum pick-up unit, the flat suction surface area being generally parallel to the insertion direction of the flat electrical circuit when the actuator is in its open position.

14. The electrical connector of claim 11, wherein the electrical connector is adapted for mounting on the printed circuit board with the terminals soldered to appropriate circuit traces on the printed circuit board, and the actuator includes at least one through-hole for the passage therethrough of cooling air during a soldering process, the through-hole extending generally parallel to the printed circuit board when the actuator is in its open position.

15. The electrical connector of claim 11, further including complementary interengaging surfaces between the actuator and the dielectric housing to maintain the actuator in its open position.

16. The electrical connector of claim 11, further including complementary interengaging surfaces between the actuator and the dielectric housing to maintain the actuator in its closed position.

17. The electrical connector of claim 11, wherein the actuator is generally L-shaped as defined by a body portion and the dust cover portion, the body portion being generally parallel to the insertion direction of the flat electrical circuit when the actuator is in its closed position, and the dust cover portion being generally perpendicular to the insertion direction when the actuator is in its closed position.

* * * * *